US007721493B2

(12) United States Patent
Skov et al.

(10) Patent No.: US 7,721,493 B2
(45) Date of Patent: May 25, 2010

(54) ROOF PANEL ASSEMBLY WITH SKYLIGHT

(75) Inventors: Erik L. Skov, Akron, OH (US); David A. Houk, Jr., North Canton, OH (US); Timothy M. Pierzynski, Apple Creek, OH (US); William F. Croft, Mooresville, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 594 days.

(21) Appl. No.: 11/121,051

(22) Filed: May 3, 2005

(65) Prior Publication Data

US 2006/0230694 A1 Oct. 19, 2006

Related U.S. Application Data

(60) Provisional application No. 60/672,688, filed on Apr. 18, 2005.

(51) Int. Cl.
*E04B 7/18* (2006.01)

(52) U.S. Cl. ..... 52/200

(58) Field of Classification Search ..... 52/200, 52/58, 302.1, 533, 789.1, 19, 20
See application file for complete search history.

(56) References Cited

U.S. PATENT DOCUMENTS

| | | | | | |
|---|---|---|---|---|---|
| 835,012 | A | * | 11/1906 | Craig | 49/463 |
| 1,053,633 | A | * | 2/1913 | Mundy | 454/199 |
| 1,499,397 | A | * | 7/1924 | Myers | 52/302.1 |
| 1,792,704 | A | * | 2/1931 | Peverley | 52/209 |
| 3,205,351 | A | * | 9/1965 | Walker | 362/490 |
| 3,521,414 | A | * | 7/1970 | Malissa | 52/107 |
| D259,812 | S | * | 7/1981 | Smith | D25/140 |
| 4,296,578 | A | * | 10/1981 | Keckman | 52/200 |
| 4,548,006 | A | | 10/1985 | Roberts, Sr. | 52/200 |
| 4,570,393 | A | * | 2/1986 | Minter | 52/72 |
| 4,823,525 | A | * | 4/1989 | Roberts et al. | 52/200 |
| 4,825,608 | A | | 5/1989 | Makin | 52/200 |
| 4,860,511 | A | | 8/1989 | Weisner et al. | 52/200 |
| 4,972,647 | A | | 11/1990 | Meldrum | 52/518 |
| 5,323,576 | A | * | 6/1994 | Gumpert et al. | 52/200 |
| 5,596,848 | A | * | 1/1997 | Lynch | 52/200 |
| 5,673,520 | A | | 10/1997 | Yannucci, III | 52/58 |
| 5,675,940 | A | | 10/1997 | Bahar et al. | 52/58 |
| 5,896,711 | A | | 4/1999 | McClure | 52/200 |
| 5,899,026 | A | | 5/1999 | Williams et al. | 52/58 |
| 6,052,956 | A | | 4/2000 | Hoy et al. | 52/200 |
| D432,667 | S | | 10/2000 | Møller | 52/58 |
| 6,151,838 | A | | 11/2000 | Husein | 52/58 |
| 6,155,008 | A | | 12/2000 | McKee | 52/198 |
| 6,256,933 | B1 | | 7/2001 | Kuhns | 52/13 |
| 6,263,624 | B1 | | 7/2001 | Hoy et al. | 52/200 |
| 6,347,484 | B1 | | 2/2002 | Swanger | 49/193 |
| 6,354,046 | B1 | * | 3/2002 | Swearingen | 52/97 |
| 6,412,229 | B2 | | 7/2002 | Kuhns | 52/13 |
| 6,418,672 | B1 | * | 7/2002 | Hampel | 52/79.1 |
| 6,457,279 | B1 | | 10/2002 | Jacobsen et al. | 52/58 |
| 6,581,337 | B1 | * | 6/2003 | Skov et al. | 52/79.5 |
| 6,622,435 | B1 | | 9/2003 | Long et al. | 52/24 |
| D484,612 | S | | 12/2003 | Greene | D25/15 |
| 6,966,157 | B1 | * | 11/2005 | Sandow | 52/200 |
| 2003/0000159 | A1 | * | 1/2003 | Estrada | 52/200 |
| 2003/0114101 | A1 | | 6/2003 | Paz | 454/224 |
| 2006/0150542 | A1 | * | 7/2006 | Brinton et al. | 52/200 |

FOREIGN PATENT DOCUMENTS

| | | | |
|---|---|---|---|
| WO | WO 94/00654 | * | 1/1994 |

* cited by examiner

*Primary Examiner*—Robert J Canfield
*Assistant Examiner*—Christine T Cajilig
(74) *Attorney, Agent, or Firm*—Dennis J. Williamson; Moore & Van Allen, PLLC

(57) ABSTRACT

A roof assembly includes a skylight panel and a roof panel. The roof panel includes a skylight opening to accommodate the skylight panel and also includes water management channels disposed adjacent to the skylight panel.

9 Claims, 7 Drawing Sheets

ROOF PANEL ASSEMBLY WITH SKYLIGHT

CROSS-REFERENCE TO RELATED APPLICATION

This application claims the benefit of U.S. Provisional Patent Application Ser. No. 60/672,688, filed Apr. 18, 2005, entitled "ROOF PANEL ASSEMBLY WITH SKYLIGHT."

BACKGROUND OF THE INVENTION

1. Field of the Disclosure

The present disclosure is generally directed to panels used for buildings and more particularly to skylights for roof panels.

2. Description of Related Art

Many storage building or shed users have to deal with a lack of light in a storage building that has no electricity or other means of illuminating the interior space. Others have tried to solve this problem in various ways, for example: by running electric power to the building and using lights; by using lights powered by batteries; by using windows in the walls of the building; and by using skylights in the roof of the building.

However, current solutions for a skylight on a pitched roof require multiple components to ensure water management and structural integrity. Multiple components complicate the assembly and/or installation of the skylight, and increase the cost for the skylight feature. All of these ways can be costly and complicated for the average consumer, especially if assembly and/or installation are to be performed by the consumer.

SUMMARY OF THE INVENTION

In accordance with one aspect of the disclosure, a roof assembly includes a skylight panel and a roof panel. The roof panel may include a skylight opening to accommodate the skylight panel, and may include water management channels disposed adjacent to the skylight panel. The skylight panel may be adapted to be snap-fit to the roof panel, and the water management channels include channels formed in the roof panel.

In accordance with another aspect of the disclosure, a roof panel includes a skylight opening adapted to accommodate a skylight panel, a raised lip surrounding the skylight opening, and at least one gutter channel disposed adjacent to the raised lip.

The skylight along with the roof geometry provides a simplified assembly with a minimum of components while still providing water management, structural integrity, and durable construction, preventing the skylight assembly from leaking and providing increased roof structure rigidity. This eliminates the need for additional flashing or other components associated with water management.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
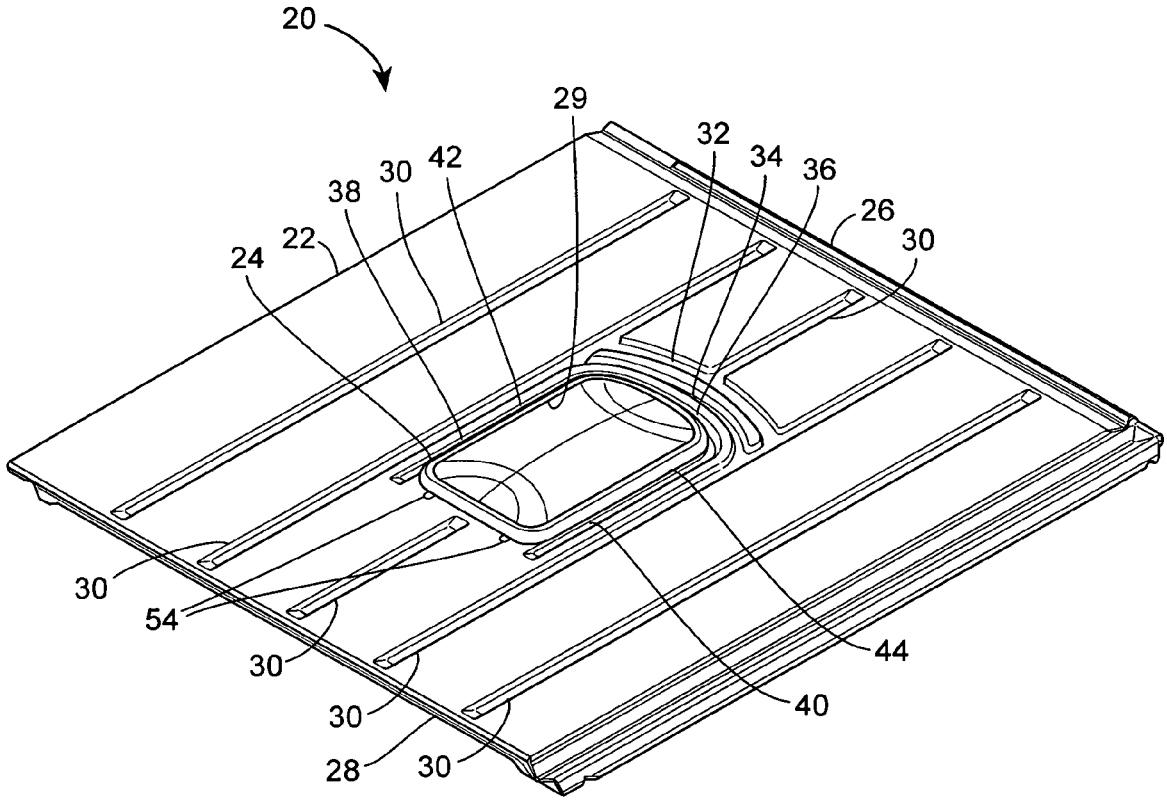
FIG. 1 is a perspective view of one example of a roof panel and skylight panel incorporating water management channels according to one aspect of the invention.
Figure 2:
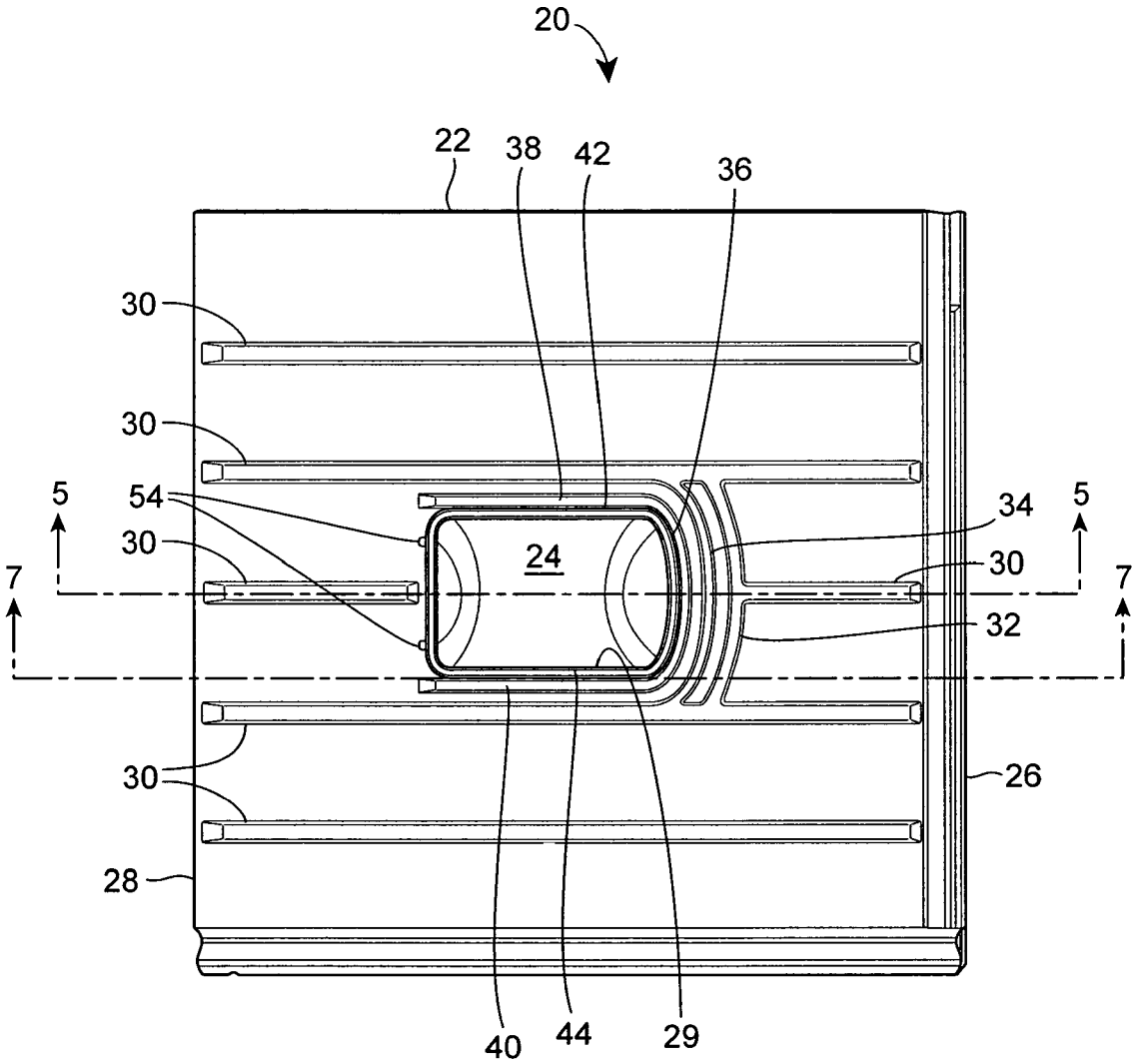
FIG. 2 is a plan view of the roof panel and skylight panel of FIG. 1.

With reference initially to FIG. 1, a roof assembly, generally indicated at 20, includes a roof panel 22 and a skylight panel 24. The roof panel 22 may include an upper edge 26 and a lower edge 28. The upper edge 26 may be disposed above the lower edge 28 when the roof panel assembly 20 is installed on a structure (not shown) such as a storage shed. For example, the upper edge 26 may be in located in the vicinity of a roof peak such that the roof panel assembly 20 is oriented at a roof pitch angle (e.g., slanted with respect to a horizontal plane), for example a 25° roof pitch angle. Such a roof pitch angle may be desirable, for example, to ensure that water will drain off of the roof panel assembly 20 in a proper manner to protect items underneath the roof panel assembly 20 from getting wet.

The roof panel 22 includes a skylight opening 29 adapted to accommodate the skylight panel 24 and may also include a plurality of straight water management channels 30 distributed along the surface of the roof panel assembly 20. The roof panel 22 may further include arcuate water management channels such as, for example, an upper arcuate water management channel 32, an intermediate arcuate water management channel 34, and a lower arcuate water management channel 36. The lower arcuate water management channel 36 may be connected to gutter channels 38 and 40, that may be disposed adjacent to side edges 42 and 44 of the skylight panel 24. Weep hole openings 54 may be provided between the roof panel 22 and the skylight panel 24, for example, to provide drainage of condensation from the interior surface of the skylight panel 24. One or more of the water management channels 30, 32, 34, and/or 33, and/or one or both of the gutter channels 38 and/or 40 may be integrally formed as part of the roof panel 22.

The roof panel 22 may be formed from a plastic material by any suitable process, such as for example, blow molding. Manufacturing the roof panel 22 using a blow-molding process enables structure such as the water management channels 30, 32, 34, and 36 and/or the gutter channels 38 and 40 to be integrated and manufactured in a single part during a single process step. Blow-molding also allows the geometry on the exterior of the roof panel 22 to be different from the interior of the roof panel 22, utilizing double-walled construction, that may also provide an added benefit of thermal insulation. However, any suitable material and any suitable process could be used for forming the roof panel 22. The skylight panel 24 may also be made from a plastic material, and may be formed by an injection molding process. Again, any suitable material and any suitable process could be used for forming the skylight panel 24.

Figure 3:
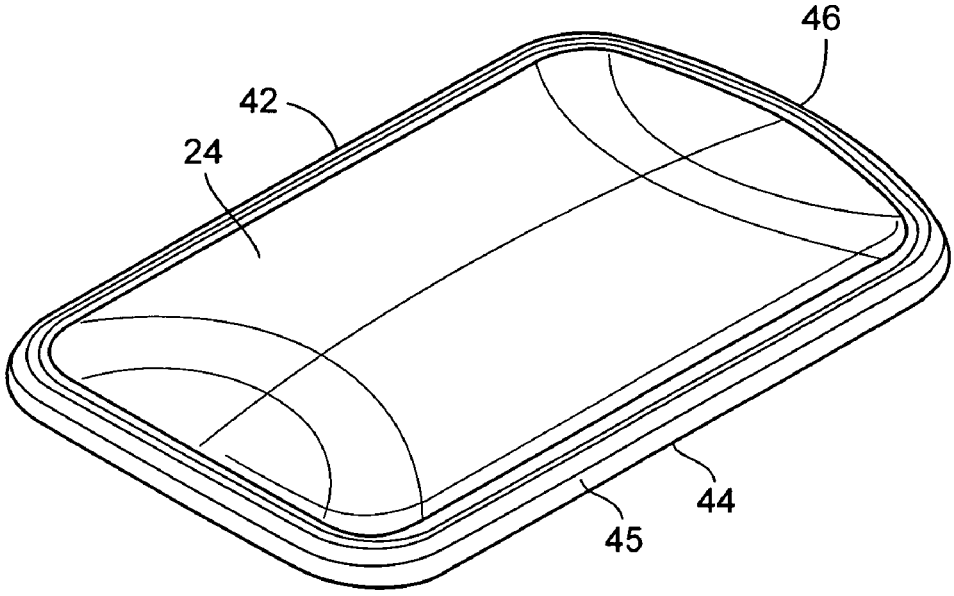
FIG. 3 is a top perspective view of the skylight panel of FIG. 1.
Figure 4:
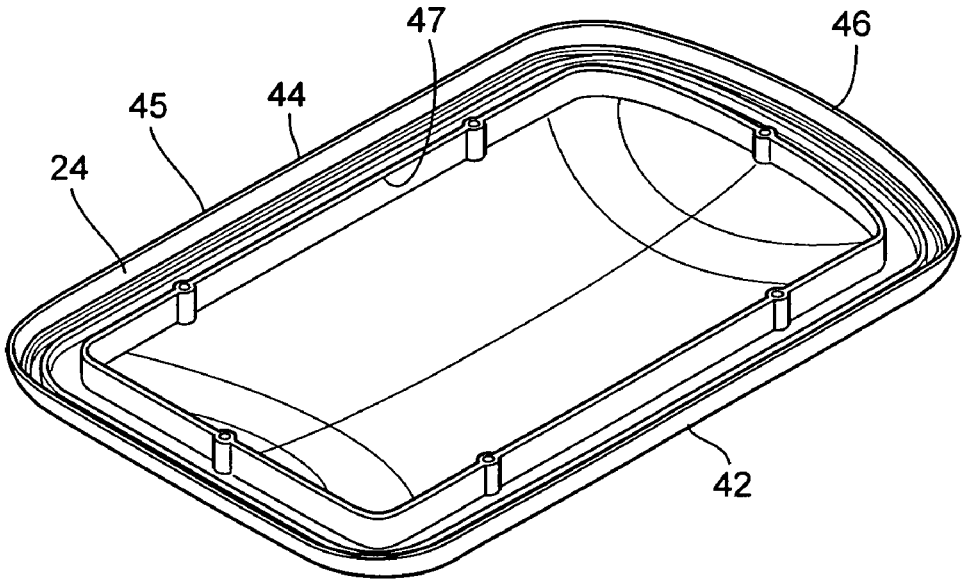
FIG. 4 is a perspective view of an interior side of the skylight panel of FIG. 3.
Figure 5:
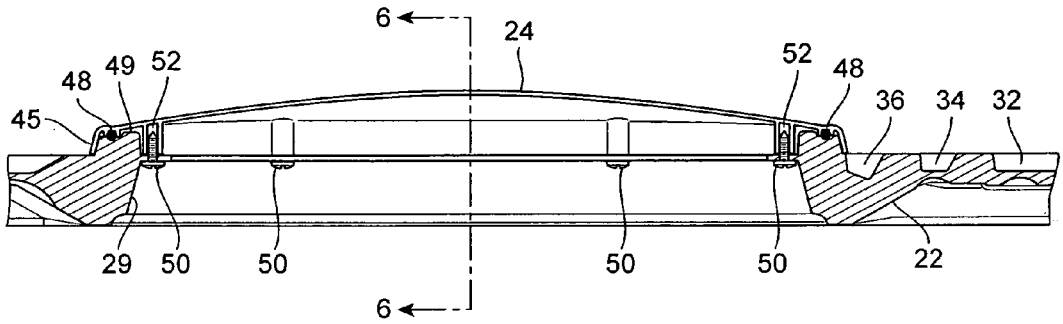
FIG. 5 is a partial cross-sectional view of the roof panel and skylight panel of FIG. 1, taken along lines 5-5 of FIG. 2.
Figure 6:
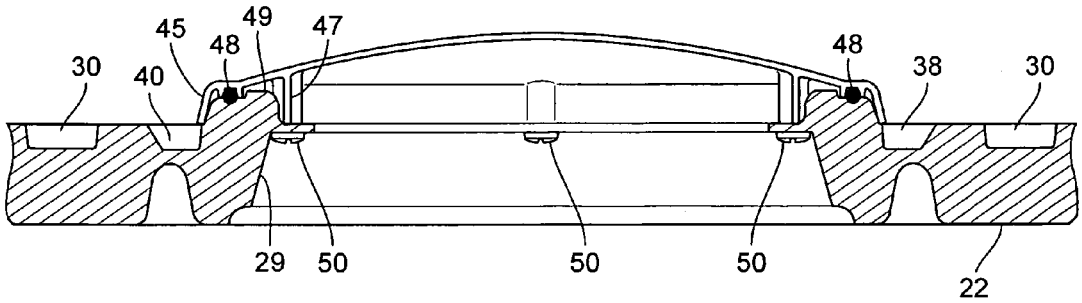
FIG. 6 is a partial cross-sectional view of the skylight panel and roof panel of FIG. 1, taken along lines 6-6 of FIG. 5.
Figure 7:
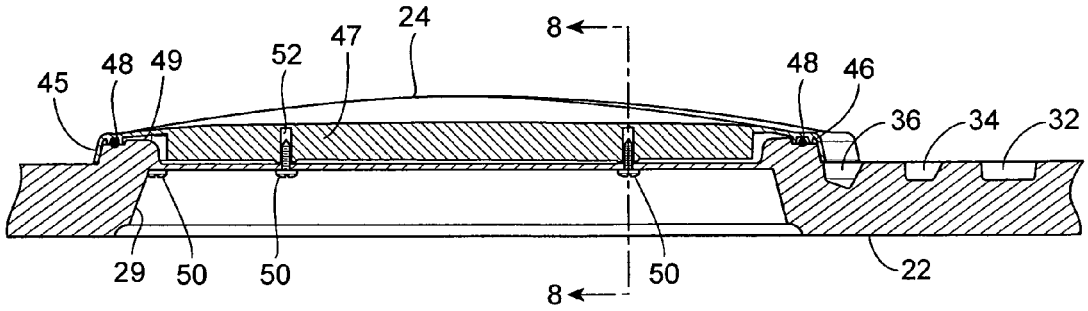
FIG. 7 is a partial cross-sectional view of the skylight panel and roof panel of FIG. 1, taken along lines 707 of FIG. 2.
Figure 8:
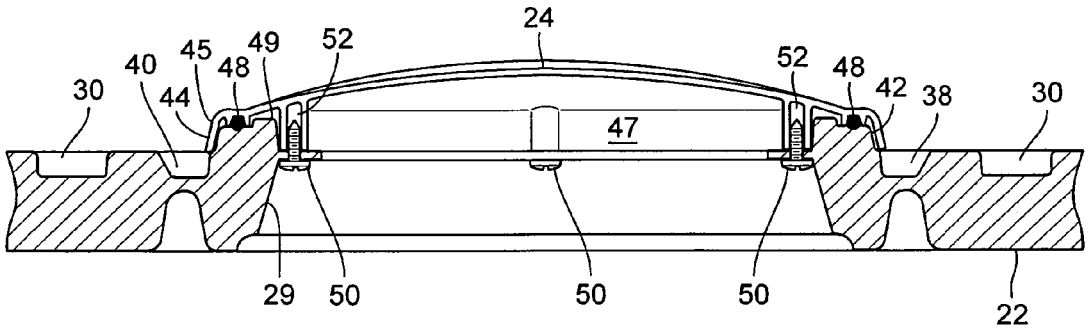
FIG. 8 is a partial cross-sectional view of the skylight panel and roof panel of FIG. 1, taken along lines 8-8 of FIG. 7.

With reference to FIGS. 3 and 4, the skylight panel 24 may include an upper end 46 having an arcuate shape that generally follows the contour of the lower arcuate water management channel 36. This arcuate shape of the upper end 46 of the skylight panel 24 helps to prevent pooling of water in the vicinity of the upper end 46 of the skylight panel 24.

The skylight panel 24 may also include a perimeter flashing flange 45 spaced apart from a perimeter mounting flange 47. When the skylight panel 24 is mounted to the roof panel 22, to cover the skylight opening 29, the perimeter flashing flange 45 and the perimeter mounting flange 47 may straddle a raised lip 49 on the roof panel 22 that surrounds the skylight opening 29.

As shown in FIGS. 5-8, a gasket 48 may be provided, sandwiched between the skylight panel 24 and the roof panel 22 along the periphery of the skylight panel 24, between the perimeter flashing flange 45 and the perimeter mounting flange 47. The skylight panel 24 may be secured to the roof panel 22 by a plurality of fasteners, such as threaded fasteners 50. Threaded fasteners 50 may be installed from the underside of the roof panel 22 and may engage blind bores 52 formed in the perimeter mounting flange 47 of the skylight panel 24, thereby preventing any possibility of leakage through seepage or flow-through fastener holes in the skylight panel 24.

In operation, when the roof assembly 20 in the vicinity of the skylight panel 24 is exposed to precipitation such as rain, melting snow, melting ice, sleet, and the like, water flows from the upper edge 26, is diverted away from the skylight panel 24 by the upper arcuate water management channel 32, the intermediate arcuate water management channel 34, and the lower arcuate water management channel 36, and may drain from the roof panel assembly 20 via the gutter channels 38 and 40. Should water collect in the lower arcuate water management channel 36 and/or the gutter channels 38 and/or 40 (e.g., due to heavy rain and or debris in the gutter channels 38 and/or 40), the raised lip 49, the perimeter flashing flange 45, and the gasket 48 each serve to prevent water from leaking between the roof panel 22 and the skylight panel 24.

Figure 9:
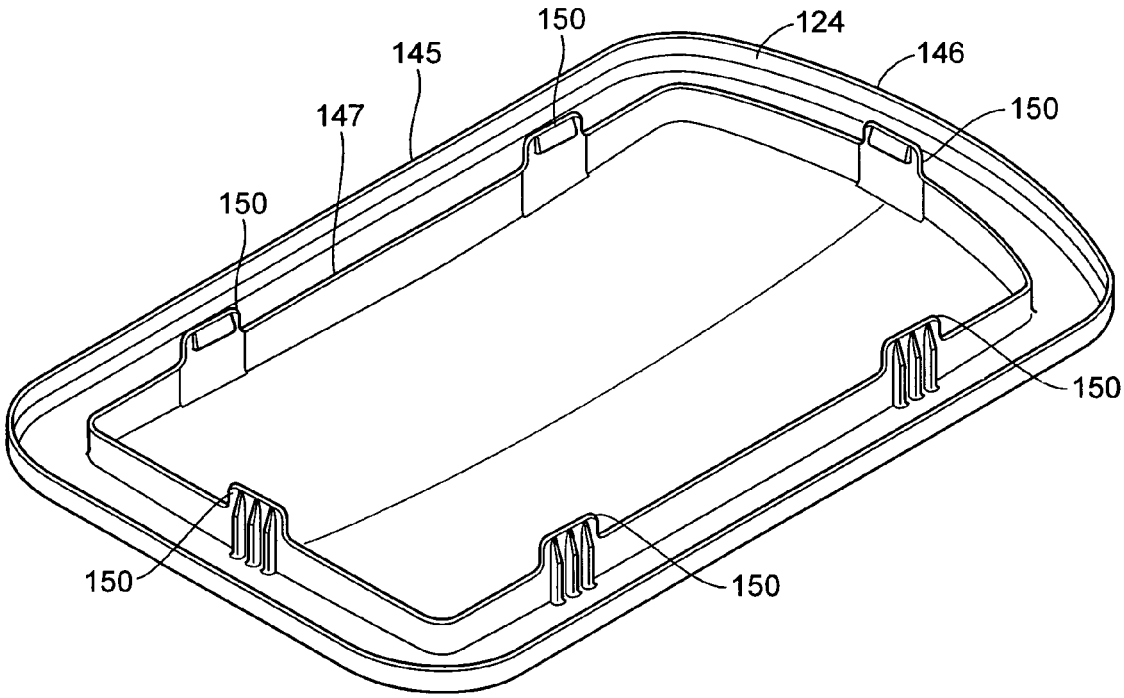
FIG. 9 is a perspective view of an interior side of a snap-fit skylight panel according to an alternative embodiment of the invention.
Figure 10:
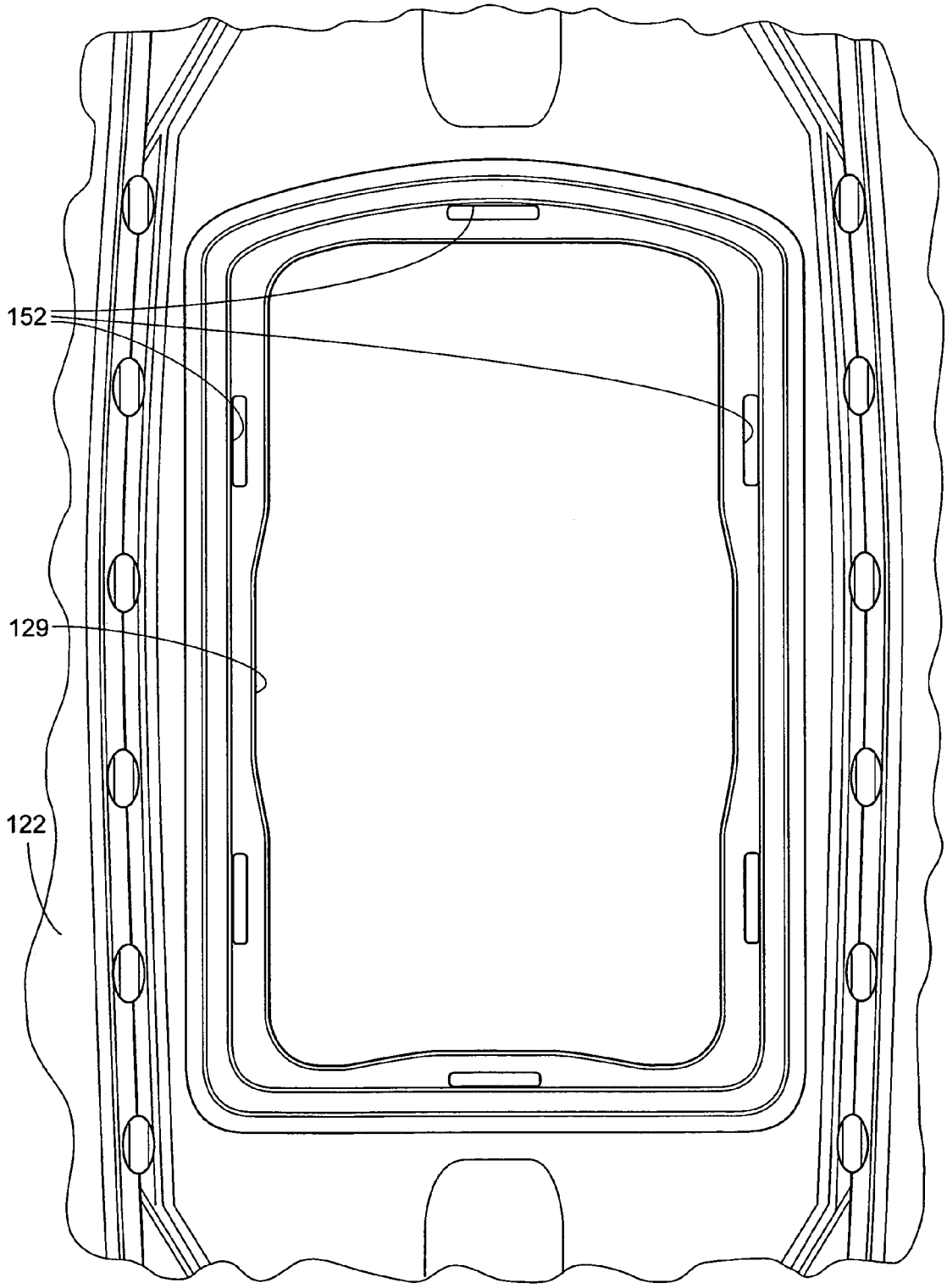
FIG. 10 is an isometric view of a portion of a lower side of a roof panel according to the alternative embodiment of the invention.

As shown in FIGS. 9 and 10, in accordance with an alternative embodiment, a skylight panel 124 may include a plurality of snap-fit tongues 150 that engage corresponding snap-fit slots 152 in a roof panel 122 (FIG. 10). Such a snap-fit connection arrangement may be instead of or in addition to using fasteners to secure the skylight panel 124 to the roof panel 122.

Although certain embodiments have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A roof panel and skylight assembly comprising:

a roof panel having a topside, an underside, an upper edge, a lower edge, and a skylight opening, a water management channel disposed near the skylight opening, and a raised lip disposed between the skylight opening and the water management channel, said roof panel including said water management channel and said raised lip being integrated in a single one-piece part;

a skylight panel mounted on said topside and including a down-turned perimeter flashing flange extending from an outer edge of the skylight panel and a mounting flange extending toward said topside, the mounting flange being spaced apart from the perimeter flashing flange, wherein the raised lip is disposed between the perimeter flashing flange and the mounting flange, the perimeter flashing flange is disposed between the raised lip and the water management channel, and the mounting flange is disposed between the raised lip and the skylight opening, the mounting flange resting on a portion of the roof panel between the skylight opening and the raised lip, and at least one fastener installed from the underside of the roof panel and engaging the roof panel and the mounting flange.

2. The roof and skylight assembly of claim 1, wherein the upper edge of the roof panel is disposed near a roof peak such that the roof panel is oriented at an angle relative to horizontal.

3. The roof and skylight assembly of claim 1, wherein the roof panel includes an upper arcuate water management channel, an intermediate arcuate water management channel, and a lower arcuate water management channel, the lower arcuate water management channel being connected to a generally linear gutter channel.

4. The roof and skylight assembly of claim 1, wherein the roof panel includes at least one recess forming a weep hole opening adjacent a bottom portion of the skylight panel, the weep hole opening positioned at least partially under the perimeter flashing flange to allow drainage of condensation from an interior surface of the skylight panel.

5. The roof and skylight assembly of claim 1, wherein the roof panel has a double wall construction.

6. The roof and skylight assembly of claim 1, wherein the skylight panel is arranged to receive a gasket between the mounting flange and the perimeter flashing flange, the gasket forming a seal between the skylight panel and raised lip of the roof panel.

7. The roof and skylight assembly of claim 1, wherein the mounting flange includes downwardly facing blind bores, the blind bores arranged to receive said at least one fastener, the roof panel and the blind bores cooperating to permit the fasteners to be installed from the underside of the roof panel, thus securing the skylight panel to the roof panel.

8. The roof and skylight assembly of claim 1, wherein the mounting flange is a continuous mounting flange.

9. The roof and skylight assembly of claim 8, wherein the continuous mounting flange extends substantially perpendicular to the roof panel.

* * * * *